US008833090B2

(12) United States Patent
Breton-Hall et al.

(10) Patent No.: US 8,833,090 B2
(45) Date of Patent: Sep. 16, 2014

(54) METHOD AND APPARATUS FOR CONTROLLING AGITATION OF A COOLING FLUID BATH FOR A DRINK DISPENSER

(75) Inventors: Melissa L. Breton-Hall, Universal City, TX (US); Rodney L. Neiman, San Antonio, TX (US); Frank Taylor, Jr., San Antonio, TX (US); Jeremiah A. Hong, San Antonio, TX (US)

(73) Assignee: Lancer Corporation, San Antonio, TX (US)

( * ) Notice: Subject to any disclaimer, the term of this patent is extended or adjusted under 35 U.S.C. 154(b) by 1575 days.

(21) Appl. No.: 12/229,604

(22) Filed: Aug. 25, 2008

(65) Prior Publication Data

US 2010/0043484 A1 Feb. 25, 2010

(51) Int. Cl.
*F25D 3/00* (2006.01)
*F25D 31/00* (2006.01)

(52) U.S. Cl.
CPC ..... *F25D 31/003* (2013.01)
USPC ..... 62/59; 62/233; 62/68

(58) Field of Classification Search
CPC ..... B67D 1/0857–1/0868; F25C 2700/08; F25C 2600/02; F25C 2700/10
USPC ..... 62/68, 233, 59, 62
See application file for complete search history.

(56) References Cited

U.S. PATENT DOCUMENTS

| | | | | |
|---|---|---|---|---|
| 3,651,656 | A * | 3/1972 | Esser et al. | 62/137 |
| 4,008,832 | A * | 2/1977 | Rodth | 222/129.1 |
| 4,497,179 | A * | 2/1985 | Iwans | 62/59 |
| 6,644,508 | B2 | 11/2003 | Haskayne et al. | 222/54 |

* cited by examiner

*Primary Examiner* — Cassey D Bauer
(74) *Attorney, Agent, or Firm* — Christopher L. Makay

(57) ABSTRACT

A drink dispenser includes a housing defining a chamber that contains a cooling fluid therein. A refrigeration unit is disposed within the housing. The refrigeration unit includes an evaporator coil extending into the cooling fluid such that a frozen cooling fluid bank forms about the evaporator coil. An agitator is disposed within the housing. The agitator extends into the cooling fluid for circulating the cooling fluid about the frozen cooling fluid bank. Dispensing valves mounted onto the housing dispense drinks from the drink dispenser. An electronic control system is disposed within the housing. The electronic control system is coupled with the agitator such that the electronic control system cycles the agitator between an agitator on period and an agitator off period. Cycling the agitator between an agitator on period and an agitator off period promotes stable growth of the frozen cooling fluid bank.

12 Claims, 3 Drawing Sheets

METHOD AND APPARATUS FOR CONTROLLING AGITATION OF A COOLING FLUID BATH FOR A DRINK DISPENSER

BACKGROUND OF THE INVENTION

1. Field of the Invention

The present invention relates to drink dispensers and, more particularly, but not by way of limitation, to a method and apparatus that controls agitation of a cooling fluid bath for a drink dispenser.

2. Description of the Related Art

A common type of drink dispenser used in food and/or drink service establishments is a counter electric drink dispenser. Counter electric drink dispensers include a housing defining a cooling chamber containing therein a cooling fluid in the form of a water bath. Dispensing valves mount onto the housing and communicate with a syrup line and one of a plain water line or carbonated water line disposed within the water bath for the purpose of formulating a drink from the syrup and the plain water or carbonated water. A refrigeration unit disposed within the housing includes an evaporator coil extending into the water bath, and operation of the refrigeration unit creates an ice bank about the evaporator coil. An agitator extends into the water bath and circulates the water in the water bath about the ice bank. Creation of the ice bank and circulation of the water in the water bath about the ice bank maintains the water bath at or near freezing for the purpose of cooling the syrup, plain water, and carbonated water flowing through the syrup, plain water, and carbonated water lines.

The ability of a counter electric drink dispenser to dispense drinks at or below a desired drink temperature depends upon the efficiency of the heat transfer between the syrup, plain water, and carbonated water flowing through the syrup, plain water, and carbonated water lines and the water bath, which, in turn, depends upon the capability of the ice bank to maintain the water bath at or near freezing. The capability of the ice bank to maintain the water bath at or near freezing relates to the stability of the ice bank in terms of size and shape. An ice bank that is too large or misshapen restricts the flow of water in the water bath thereabout diminishing the cooling of the water by the ice bank. An ice bank that is too small is incapable of sufficiently cooling the water in the water bath.

A factor in ice bank stability is an agitator properly agitating the water in the water bath about the ice bank. Unfortunately optimal agitation is difficult to achieve as agitators typically run continuously at a set speed. Such operation is wasteful of energy and quite often fails to achieve ice bank stability. Higher speeds achieve good circulation but frequently wash out the ice bank making it too small or misshapen. Lower speeds prevent wash out but regularly fail to prevent over or misshapen growth of the ice bank and the resulting problems. An existing solution involves operating the agitator at different speeds dependent upon the operating conditions of the counter electric drink dispenser. This does enhance ice bank stability over a set speed but such a solution still experiences the energy inefficiency involved with continuous operation of the agitator.

Accordingly, a method and apparatus that achieves ice bank stability while increasing energy efficiency will provide an improvement in counter electric drink dispensers.

SUMMARY OF THE INVENTION

In accordance with the present invention, a method and apparatus incorporated into a drink dispenser controls cooling fluid bath agitation such that stable frozen cooling fluid bank growth is achieved. A drink dispenser incorporating the present invention includes a housing defining a chamber that contains a cooling fluid therein. A refrigeration unit is disposed within the housing. The refrigeration unit includes an evaporator coil extending into the cooling fluid such that a frozen cooling fluid bank forms about the evaporator coil. An agitator is disposed within the housing. The agitator extends into the cooling fluid for circulating the cooling fluid about the frozen cooling fluid bank. Dispensing valves mounted onto the housing dispense drinks from the drink dispenser.

The method and apparatus of the present invention is implemented through an electronic control system disposed within the housing. The electronic control system is coupled with the agitator such that the electronic control system cycles the agitator between an agitator on period and an agitator off period. The electronic control system activates the agitator at the beginning of the agitator on period and deactivates the agitator at the end of the agitator on period. The electronic control system further maintains the agitator deactivated during the agitator off period. The electronic control system restarts the agitator on period responsive to activation of a dispensing valve during the agitator on period. The electronic control system restarts the agitator on period if the previously activated dispensing valve is reactivated prior to expiration of the current agitator on period. The electronic control system also restarts the agitator on period responsive to activation of a different dispensing valve prior to expiration of the current agitator on period. Moreover, the electronic control system starts the agitator on period responsive to activation of a dispensing valve during the agitator off period.

A method for controlling agitation of a cooling fluid bath in a drink dispenser cycles the agitator between an agitator on period and an agitator off period. In particular, the agitator is activated, and the agitator on period is begun. At the expiration of the agitator on period, the agitator is deactivated, and the agitator off period is begun. The agitator remains off during the agitator off period. At the expiration of the agitator off period, the agitator is reactivated for a repeat of the foregoing cycle.

The dispensing valves are monitored for activation. The agitator remains activated and the agitator on period is restarted responsive to activation of a dispensing valve during the agitator on period. The agitator remains activated and the agitator on period is restarted if the previously activated dispensing valve is reactivated prior to expiration of the current agitator on period. The agitator remains activated and the agitator on period is restarted if a different dispensing valve activates prior to expiration of the current agitator on period. The agitator is activated and the agitator on period is begun responsive to activation of a dispensing valve during the agitator off period.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps. While the preferred embodiment has been described, the details may be changed without departing from the invention, which is defined by the claims.

Figure 1:
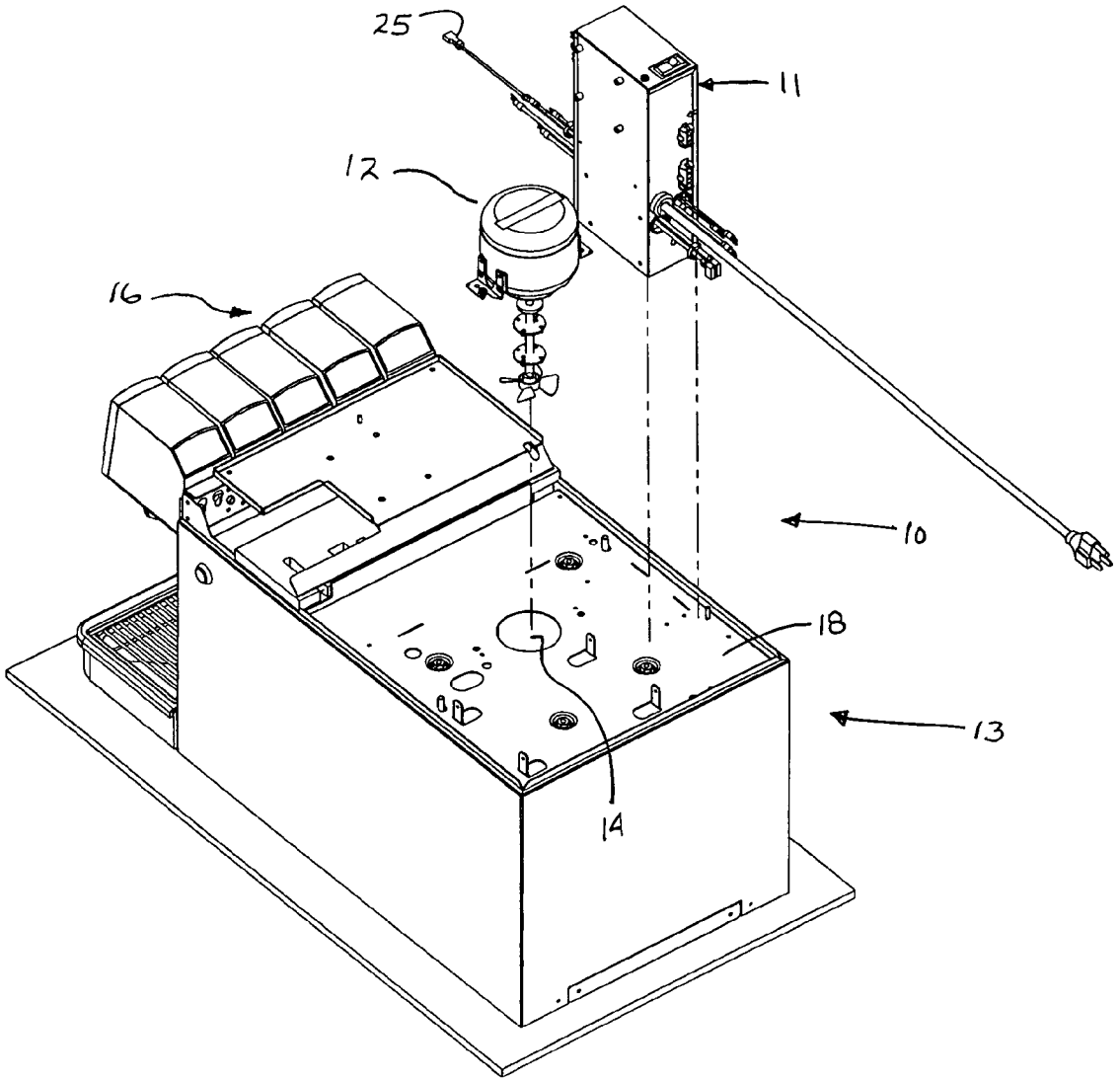
FIG. 1 is a perspective view illustrating a drink dispenser incorporating an electronic control system that controls the operation of the drink dispenser including an agitator.
Figure 2:
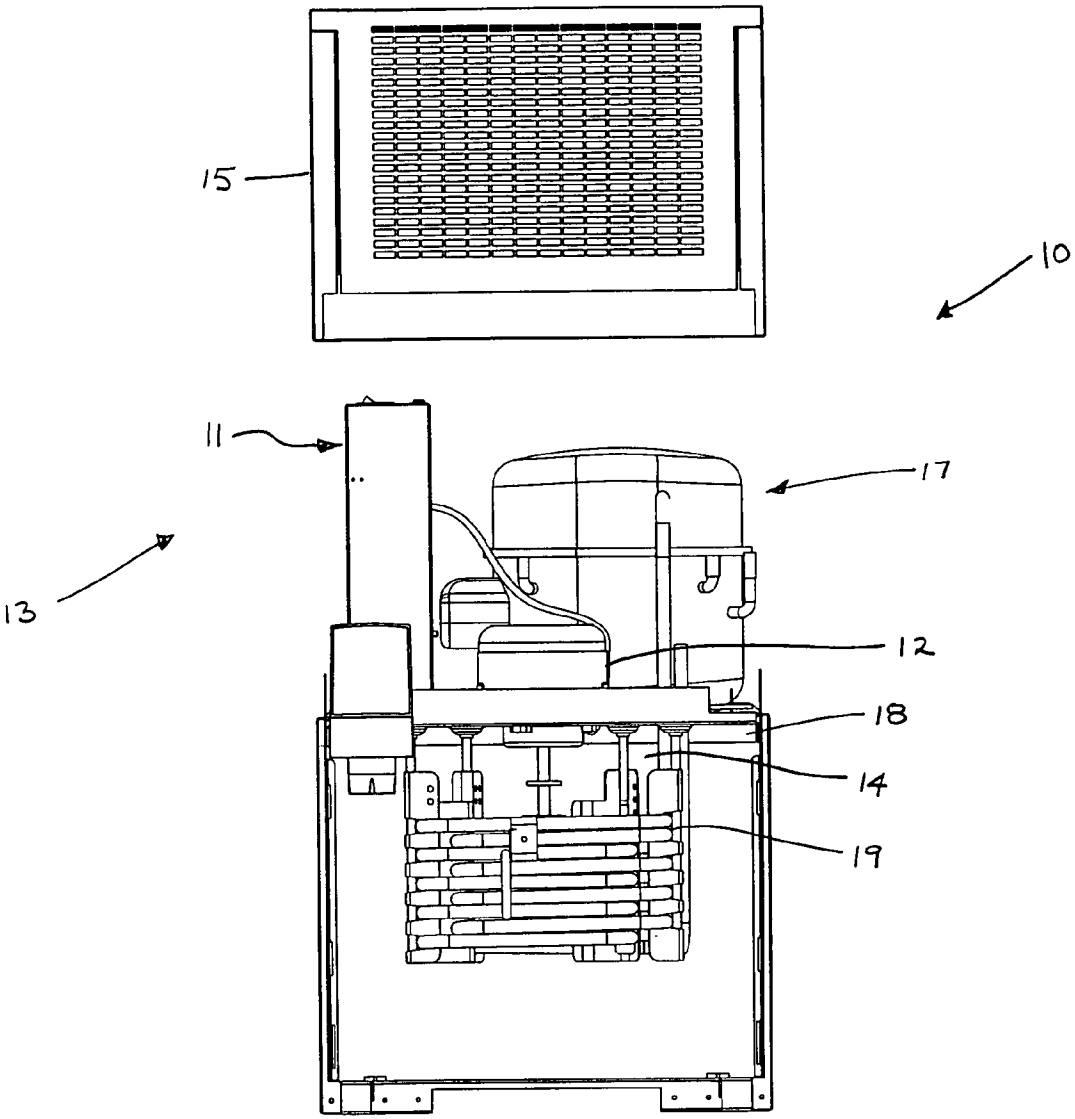
FIG. 2 is a front view illustrating a drink dispenser incorporating an electronic control system that controls the operation of the drink dispenser including an agitator.

FIGS. 1 and 2 illustrate a drink dispenser 10 incorporating an electronic control system 11 that controls the operation of the drink dispenser 10 including an agitator 12. In this preferred embodiment, the drink dispenser 10 is a counter electric drink dispenser, which is defined as any drink dispenser employing a mechanical means to cool dispensed drinks. The size, shape, and individual components of such a drink dispenser will vary depending upon user requirements. The preferred embodiment accordingly is not to be limited based upon drink dispenser requirements, and any drink dispenser including mechanical means to cool dispensed drinks are considered within the scope of the present invention.

For the sake of disclosure and to illustrate the present invention, the drink dispenser 10 will be described more fully herein; nevertheless, the present invention is not to be limited to the specifics of the disclosed drink dispenser 10. The drink dispenser 10 includes a housing 13 defining a chamber 14 that contains therein a cooling fluid in the form of a water bath. The housing 13 includes a cover 15 that fits over the chamber 14. Dispensing valves 16 mount onto the housing 13. Syrup lines disposed within the chamber 14 each communicate at an inlet end with a syrup source and at an outlet end with a respective dispensing valve 16, with the number of syrup lines corresponding to the number of dispensing valves 16. A carbonated water line disposed within the chamber 14 communicates at an inlet end with a carbonator and at an outlet end with a manifold that delivers carbonated water to a respective dispensing valve 16, with the number of dispensing valves receiving carbonated water corresponding to the number of carbonated drinks dispensed from the drink dispenser 10. The carbonator connects with a source of carbon dioxide gas and a source of plain water. A plain water line disposed within the chamber 14 communicates at an inlet end with a plain water source and at an outlet end with a manifold that delivers plain water to a respective dispensing valve 16, with the number of dispensing valves receiving plain water corresponding to the number of carbonated drinks dispensed from the drink dispenser 10. The plain water line may also supply water to the carbonator when the carbonator resides within the chamber 14. Each dispensing valve 16 receives syrup and one of carbonated water and plain water for the purpose of formulating a drink dispensed from the drink dispenser 10. While the drink dispenser 10 has been described as a post-mix dispenser, it should be understood that the drink dispenser 10 may be a pre-mix dispenser.

A refrigeration unit 17 resides atop a deck 18, which, in turn, is disposed within the housing 13. The refrigeration unit 17 includes an evaporator coil 19 beneath the deck 18 that extends into the water bath contained within the chamber 13. Operation of the refrigeration unit 17 creates an ice bank about the evaporator coil 19. The agitator 12 mounts atop the deck 18 and extends into the water bath to circulate the water in the water bath about the ice bank. Creation of the ice bank and circulation of the water in the water bath about the ice bank maintains the water bath at or near freezing for the purpose of cooling the syrup, plain water, and carbonated water flowing through the syrup, plain water, and carbonated water lines.

The electronic control system 11 mounts atop the deck 18 and is electrically connected with the components of the drink dispenser 10 for the purpose of monitoring and controlling the operation of the drink dispenser 10. Illustratively, the electronic control system 11 electrically connects with the dispensing valves 16 via an electrical connector 25 such that the electronic control system 11 monitors and controls the actuation and deactuation of the dispensing valves 16. The electronic control system 11 further electrically connects with the agitator 12 for the purpose of controlling the operation of the agitator 12. In this preferred embodiment, the electronic control system 11 controls all drink dispenser operations including the operation of the agitator 12. Such an electronic control system would include a microcontroller and associated circuitry as well as the electrical connections and sensors necessary for the microcontroller to monitor and direct drink dispenser operations including an electrical input connectable with a power source such that the electronic control system distributes power throughout the drink dispenser. Nevertheless, it should be understood that a separate dedicated microcontroller, associated circuitry, electrical connections, and sensors may be utilized to control the agitator 12.

The electronic control system 11 controls the cycle time of the agitator 12 which consists of an agitator on period and an agitator off period. During the agitator on period, the electronic control system 11 typically runs the agitator 12 at "full on", thereby providing for aggressive agitation of the water bath. Nevertheless, it should be understood that the agitator 12 may run at a speed less than "full on" depending upon the conditions under which the drink dispenser 10 operates. The length of the cycle time as well as the length of the agitator on period and the length of the agitator off period during the cycle time are predetermined and depend upon the conditions under which the drink dispenser 10 operates, such as temperature, as well as the characteristics of the drink dispenser 10 employing the present invention, such as the sizes of the water bath and the refrigeration unit 17. A cycle time of 14½ minutes with an agitator on time of 1 minute and an agitator off time of 13½ has been found to achieve ice bank stability in most applications of the present invention. It should be understood however that the cycle time and the lengths of the agitator on/off periods within the cycle time may be set at any time necessary to achieve ice bank stability. Illustratively, the length of the agitator on period may be less than, the same, or greater than the length of the agitator off period.

In operating the agitator 12 "off" during the agitator off period and "on" during the agitator on period, the electronic control system 11 optimizes the size and stability of the ice bank. In the agitator off period, the ice bank is allowed to grow such that it is of sufficient size to optimize the transfer of heat from the water bath to the ice bank. In the agitator on period, the agitator 12 circulates the water in the water bath about the ice bank with sufficient aggressiveness such that optimal transfer of heat from the water bath to the ice bank occurs. Accordingly, cycling the agitator 12 on and off facilitates optimal growth of the ice bank in terms of size and shape while still allowing sufficient agitation of the water bath to effectively and efficiently cool the syrup, plain water, and carbonated water flowing through the syrup, plain water, and carbonated water lines.

Figure 3:
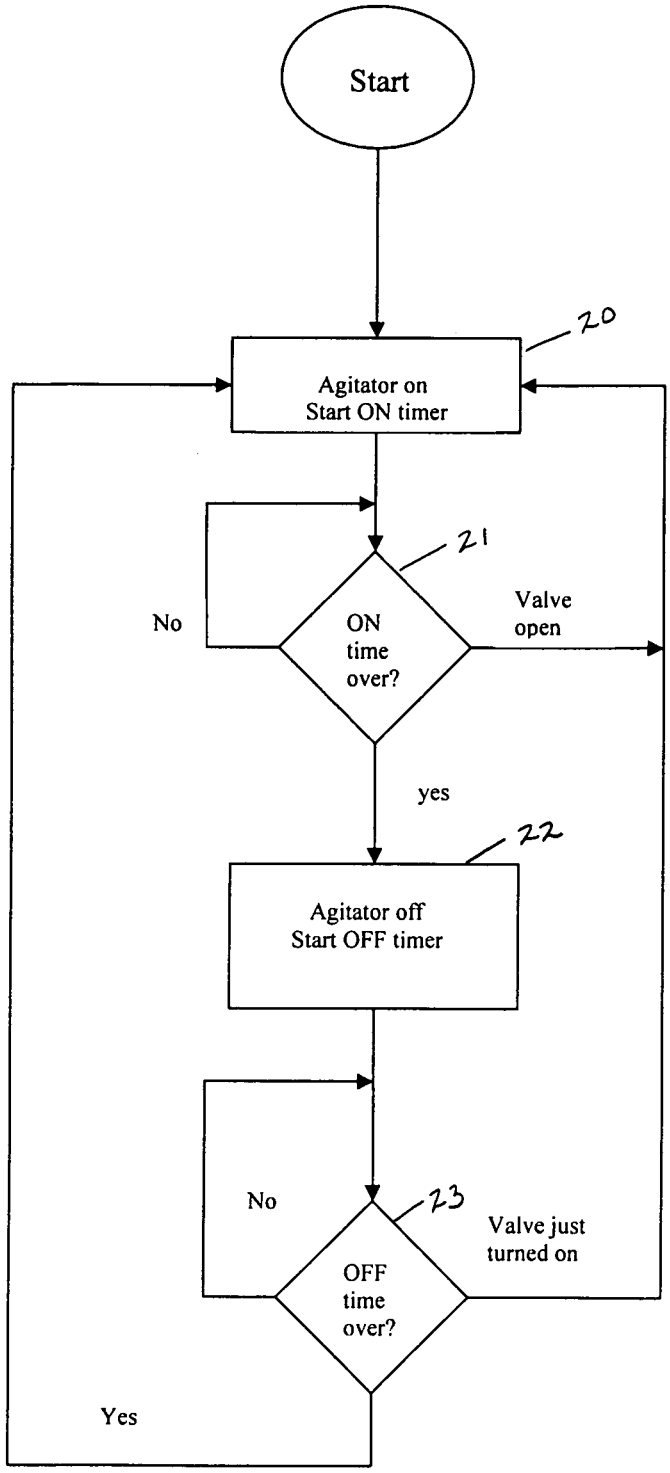
FIG. 3 is a flow chart illustrating an example control routine executed by the electronic control system.

FIG. 3 provides an example control routine executed by the electronic control system 11 in controlling the agitator 12. After start of drink dispenser operations, the electronic control system 11 proceeds to step 20 and activates the agitator 12 while simultaneously starting an agitator on period timer. The electronic control system 11 proceeds to step 21 and determines if the agitator on period has expired. As long as the agitator on period has not expired, the electronic control system 11 remains at step 21. Once the electronic control system 11 determines the agitator on period has expired, the electronic control system 11 proceeds to step 22 and deactivates the agitator 12 while simultaneously starting an agitator off period timer. The electronic control system 11 proceeds to step 23 and determines if the agitator off period has expired. As long as the agitator off period has not expired, the electronic control system 11 remains at step 23. Once the electronic control system 11 determines the agitator off period has expired, the electronic control system 11 returns to step 20 for repeat of the program steps.

An additional feature in the control of the agitator 12 is the running of the agitator 12 during valve operation. In step 21, the electronic control system 11 monitors the dispensing valves 16. If one or more of the dispensing valves 16 activates while the electronic control system 11 is performing step 21, the electronic control system 11 immediately exits step 21 and proceeds to step 20. Once at step 20, the electronic control system 11 maintains activation of the agitator 12 and restarts the agitator on period timer. After resetting the agitator on period timer, the electronic control system 11 proceeds to step 21 and monitors the agitator on period timer. If the previously activated dispensing valve 16 or a different one of the dispensing valves 16 activates while the electronic control system 11 is performing step 21, the electronic control system 11 again immediately exits step 21 and proceeds to step 20 for operation as described above. The electronic control system 11 accordingly runs the agitator 12 as long as the previously activated dispensing valve 16 is reactivated or a new dispensing valve or valves 16 is activated prior to the expiration of the agitator on time period. Once the agitator on time period expires without reactivation of the previously activated dispensing valve 16 or activation of a new dispensing valve or valves 16, the electronic control system 11 proceeds to step 22 for operation as previously described.

Furthermore, the electronic control system 11 in step 23 monitors the dispensing valves 16. If one or more of the dispensing valves 16 activates while the electronic control system 11 is performing step 23, the electronic control system 11 immediately exits step 23 and proceeds to step 20. Once at step 20, the electronic control system 11 activates the agitator 12 and starts the agitator on period timer. After resetting the agitator on period timer, the electronic control system 11 proceeds to step 21 for monitoring of the agitator on period timer. The electronic control system 11 accordingly runs the agitator 12 immediately responsive to the activation of one or more dispensing valves.

While the example control routine illustrated in FIG. 2 optimizes the size and stability of an ice bank, it should be understood that the routine may be modified based on drink dispenser operating conditions and that such modifications are within the scope of the present invention. As an illustrative example, it may be necessary to increase the agitator on period and decrease the agitator off period during peak use times, such as a lunch rush. The electronic control system 11 would track the time of day, and, just prior to a peak use time, the electronic control system 11 would increase the agitator on period over the normal agitator on period and decrease the agitator off period over the normal agitator off period. After the end of the peak use period, the electronic control system 11 would return to the normal agitator on period and normal agitator off period. Alternatively, high ambient temperatures may warrant a larger ice bank created during the night in order to meet demands during the day. The electronic control system 11 would track the time of day, and, sometime during the night, the electronic control system 11 would decrease the agitator on period over the normal agitator on period and increase the agitator off period over the normal agitator off period. In the morning, the electronic control system 11 would return to the normal agitator on period and normal agitator off period.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

The invention claimed is:

1. A method for controlling agitation of a cooling fluid bath in a drink dispenser, comprising the steps of:

coupling an electrical input of an electronic control system with a power source to distribute power throughout the drink dispenser;

during an activation step, simultaneously activating an agitator and activating an agitator ON timer using the electronic control system;

when the agitator ON timer expires initiating a deactivation step;

during said deactivation step, simultaneously deactivating the agitator and activating an agitator OFF timer using the electronic control system;

when the agitator OFF timer expires initiating the activation step; and cycling the agitator using the electronic control system between the activation step and deactivation step for the entire duration the electrical input of the electronic control system remains coupled with the power source.

2. The method for controlling agitation of a cooling fluid bath in a drink dispenser according to claim 1, further comprising the step of monitoring for activation of one of a plurality of dispensing valves.

3. The method for controlling agitation of a cooling fluid bath in a drink dispenser according to claim 2, further comprising restarting the agitator ON timer responsive to activation of a dispensing valve prior to expiration of the ON timer.

4. The method for controlling agitation of a cooling fluid bath in a drink dispenser according to claim 3, further comprising restarting the agitator ON timer if the previously activated dispensing valve is reactivated prior to expiration of the current agitator ON timer.

5. The method for controlling agitation of a cooling fluid bath in a drink dispenser according to claim 3, further comprising restarting the agitator ON timer if a different dispensing valve activates prior to expiration of the ON timer.

6. The method for controlling agitation of a cooling fluid bath in a drink dispenser according to claim 2, further comprising switching to the activation step responsive to activation of a dispensing valve prior to the expiration of the OFF timer.

7. A method for controlling agitation of a cooling fluid bath in a drink dispenser, comprising the steps of:

a. coupling an electrical input of an electronic control system with a power source to distribute power throughout the drink dispenser;

b. activating an agitator using the electronic control system;

c. activating an ON timer to begin an agitator on period;

d. deactivating the agitator at the expiration of the ON timer to end the agitator on period using the electronic control system;

e. activating an OFF timer to begin an agitator off period;

f. maintaining the agitator deactivated during the agitator off period; and g. returning to step b at the expiration of the OFF timer to end the agitator off period such that the electronic control system cycles the agitator between the agitator on period and the agitator off period for the entire duration the electrical input of the electronic control system remains coupled with the power source.

8. The method for controlling agitation of a cooling fluid bath in a drink dispenser according to claim 7, further comprising the step of monitoring for activation of one of a plurality of dispensing valves.

9. The method for controlling agitation of a cooling fluid bath in a drink dispenser according to claim 8, further comprising returning to step c responsive to activation of a dispensing valve during the agitator on period.

10. The method for controlling agitation of a cooling fluid bath in a drink dispenser according to claim 9, further comprising returning to step c if the previously activated dispensing valve is reactivated prior to expiration of the current agitator on period.

11. The method for controlling agitation of a cooling fluid bath in a drink dispenser according to claim 9, further comprising returning to step c if a different dispensing valve activates prior to expiration of the current agitator on period.

12. The method for controlling agitation of a cooling fluid bath in a drink dispenser according to claim 8, further comprising returning to step b responsive to activation of a dispensing valve during the agitator off period.

* * * * *